US006917335B2

(12) United States Patent
Kadambi et al.

(10) Patent No.: US 6,917,335 B2
(45) Date of Patent: Jul. 12, 2005

(54) ANTENNA WITH SHORTED ACTIVE AND PASSIVE PLANAR LOOPS AND METHOD OF MAKING THE SAME

(75) Inventors: Govind R. Kadambi, Lincoln, NE (US); Ted S. Hebron, Lincoln, NE (US); Willis R. Hardy, York, NE (US); Sripathi Yarasi, Lincoln, NE (US)

(73) Assignee: Centurion Wireless Technologies, Inc., Lincoln, NE (US)

( * ) Notice: Subject to any disclaimer, the term of this patent is extended or adjusted under 35 U.S.C. 154(b) by 5 days.

(21) Appl. No.: 10/622,890

(22) Filed: Jul. 16, 2003

(65) Prior Publication Data

US 2004/0178958 A1 Sep. 16, 2004

Related U.S. Application Data

(60) Provisional application No. 60/424,850, filed on Nov. 8, 2002.

(51) Int. Cl.[7] ..... H01Q 1/38

(52) U.S. Cl. ..... 343/700 MS; 343/728; 343/866

(58) Field of Search ..... 343/700 MS, 866, 343/741, 867, 742, 702, 728

(56) References Cited

U.S. PATENT DOCUMENTS 6,008,762 A * 12/1999 Nghiem ..... 343/700 MS
6,166,694 A 12/2000 Ying ..... 343/702
6,552,686 B2 * 4/2003 Ollikainen et al. .. 343/700 MS
6,650,295 B2 * 11/2003 Ollikainen et al. .. 343/700 MS
6,693,594 B2 * 2/2004 Pankinaho et al. .. 343/700 MS
6,707,428 B2 * 3/2004 Gram ..... 343/700 MS
6,734,825 B1 * 5/2004 Guo et al. ..... 343/700 MS

OTHER PUBLICATIONS

International Searching Authority, "Notification of Transmittal of the International Search Report and the Written Opinion of the International Searching Authority" Dec. 6, 2004.

* cited by examiner

*Primary Examiner*—Tuyet Vo
*Assistant Examiner*—Ephrem Alemu
(74) *Attorney, Agent, or Firm*—Holland & Hart LLP

(57) ABSTRACT

An internal antenna for wireless devices comprising a ground plane and a planar loop antenna. The shorted loop antenna is provided with a gap and operates at a quarter wavelength. The compact single feed dual or multi band internal antenna is realized either through composite assembly of an active outer and inner radiating elements or by a selective combination of an active outer radiating element and a parasitic inner radiating element. The inner radiating element of the proposed invention is completely encompassed within the outer radiating element. The resonant tuning of the internal antenna is accomplished by means of the matching stub and capacitive loading plates with the matching stubs being entirely internal to the outer radiating element.

71 Claims, 5 Drawing Sheets

ANTENNA WITH SHORTED ACTIVE AND PASSIVE PLANAR LOOPS AND METHOD OF MAKING THE SAME

RELATED APPLICATIONS

The present invention is related to U.S. patent application Ser. No. 10/314,791, filed Dec. 12, 2002, titled COMPACT LOW PROFILE SINGLE FEED MULTI BAND PRINTED ANTENNAS, Kadambi et al. U.S. patent application Ser. No. 10/135,312, filed Apr. 29, 2002 titled SINGLE FEED TRI BAND PIFA WITH PARASITIC ELEMENT, Kadambi et al., and U.S. Provisional Patent Application Ser. No. 60/424,850, filed Nov. 8, 2002, titled OPTIMUM UTILIZATION OF SLOT GAP IN PIFA DESIGN, Kadambi et al.

FIELD OF THE INVENTION

The present invention relates to antenna and, more particularly, to antenna having shorted planar loops.

BACKGROUND OF THE INVENTION

The cellular communication technology has witnessed a gradual and increasing trend of using internal antennas instead of more conventional external antenna. Cellular communication also has experienced an increase and an enhanced emphasis on multi band and multi system capabilities of cellular handsets. These changes have caused a growing demand for single feed single and multi band internal antennas for system applications comprising both the cellular and non-cellular frequency bands, which include GPS and Bluetooth.

The Planar Inverted F-Antenna (PIFA) has proven to be a versatile choice as an internal antenna for the multi band and multi system antenna. However, the PIFA requires a relatively large volume of space in present compact wireless devices. Despite many improvements in PIFAs, the volume or amount of space the PIFA occupies continues to be a significant determining factor for its desirable performance.

In view of the emerging constraints on the available volume for internal antennas, there is a need to look for potentially more efficient planar antenna configurations.

SUMMARY OF THE INVENTION

To attain the advantages of and in accordance with the purpose of the present invention, an antenna with shorted active and passive planar loops in provided. The antenna is comprised of a conductive trace forming a first radiating element residing over a ground plane. The radiating element forms a loop antenna having a gap. The loop antenna has a radiating edge opposite a non radiating edge. A shorting element and feed tab are located on the non radiating edge. Multi band operating of the antenna is achieved by placing a second radiating element where at least a portion of the second radiating element is internal to a geometry formed by the first radiating element.

The foregoing and other features, utilities and advantages of the invention will be apparent from the following more particular description of a preferred embodiment of the invention as illustrated in the accompanying drawings.

BRIEF DESCRIPTION OF THE DRAWING

The above and other objects and advantages of the present invention will be apparent upon consideration of the following detailed description, taken in conjunction with the accompanying drawings, in which like reference characters refer to like parts throughout, and in which.

DETAILED DESCRIPTION

Figure 1:
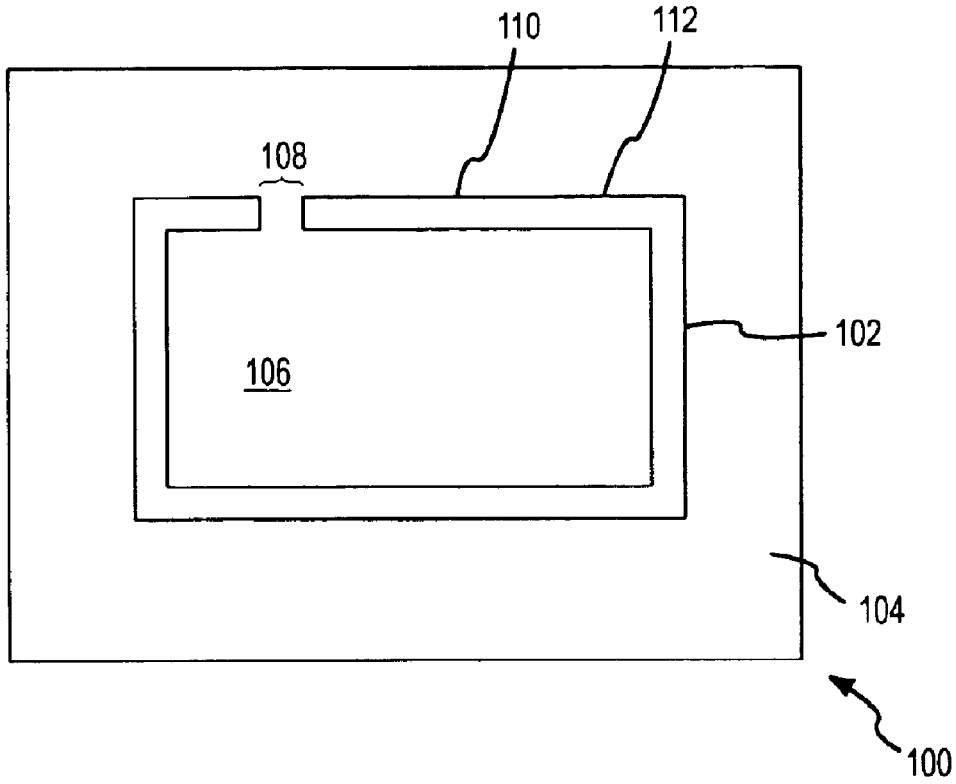
FIG. 1 is a plan view of an embodiment of an antenna consistent with the present invention.
Figure 1A:
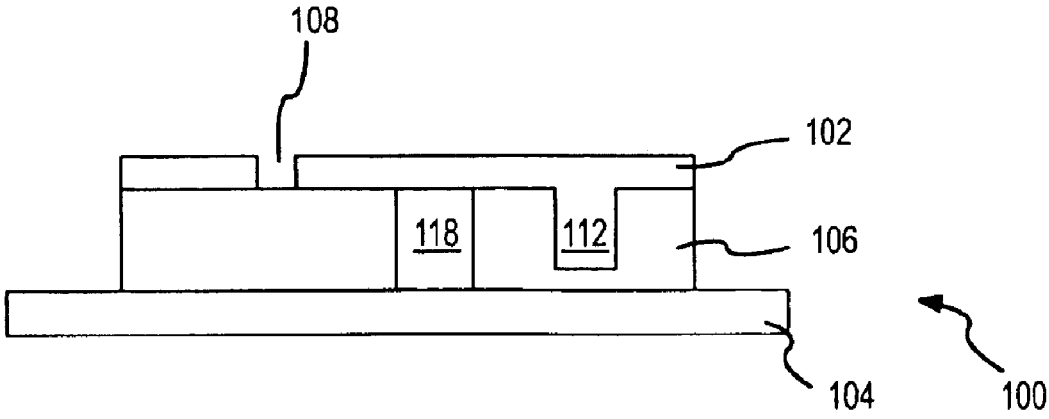
FIG. 1A is an elevation view of the antenna of FIG. 1.

FIGS. 1–5 and the following paragraphs describe some embodiments of the present invention. Like reference characters are used wherever possible to identify like components or blocks to simplify the description of the various subcomponents described herein. More particularly, the present invention is described in relation to particular embodiments thereof; however, one of ordinary skill in the art will understand on reading the following disclosure that other configurations are possible without departing from the spirit and scope of the present invention.

Conventionally, almost all PIFA designs involve the formation of a slot on the radiating element of the PIFA. The slot forms a quasi partitioning of the radiating element allowing the PIFA to operate in multiple frequency bands. As is well known in the art, the design parameters of interest dictate the position of the slot with respect to a feed post and a shorting post as well as the slot's contour and length. The slot not only quasi partitions the PIFA to provide multiple band operation, but also is a reactive loading tool to reduce the resonant frequencies of the radiating element. The radiating element of a PIFA also contains capacitive loading elements that are usually bent segments extending from the edges of the radiating plane towards, but not touching, the ground plane.

While both the slot loading and capacitive loading degrade the gain and bandwidth of the PIFA, they are useful techniques for tuning that does not increase the physical size of the PIFA. However, the overall size of the PIFA does constrain the amount of slot loading and capacitive loading permissible.

When the volume wireless devices allot for antenna decreases, it decreases the permissible slot length that, in turn, decreases the slot loading. With conventional PIFA designs, the size constraints often make it difficult to realize the single or dual resonance at appropriate frequencies.

It has been discovered, however, that single or multiple band performance can be achieved using planar loop antennas. The planar loop antennas provide appropriate response using smaller volumes than conventional PIFAs.

Loop antennas of the present invention can take various configurations including square, rectangular, circular, elliptical, meander, or the like. Conventionally, loop antennas operate at half wavelength for desirable performance. Because conventional loop antennas operate at the half wavelength, they are not associated with shorting strips or vias connecting the radiating element to the ground plane. Further, conventional loop antennas are not usually placed above the ground plane.

To make the conventional loop antenna operable for internal antennas associated with wireless devices, the loop antenna is oriented above the ground plane and for quarter wavelength operation. These modifications to the conventional loop antenna are due, in part, to the limited volume available for internal antennas in most wireless devices.

Shorting the radiating element of the loop antenna to the ground plane still allows for operation at the appropriate resonant frequency. Further, shorting the radiating element and the ground plane for quarter wavelength operation results in a desirable reduction in the size of the loop. Of course, placing the radiating element above the ground plane and shorting the radiating element to the ground plane changes the resonance characteristics of the loop antenna.

A gap or slot provided in loop antenna of the present invention provides additional control of the desired resonance characteristics of the antenna. Multi band operation is achieved by providing two loop antennas coupled through a connecting stub, typically near the feed point of the antenna. Alternatively, multi band operation can be achieved by shorting a combination of active and passive (parasitic) planar loops to the ground plane. It is believed the combination of active and passive loops imparts an easy control of the resonance characteristics of a particular band of operation without significantly influencing another band.

As one of skill in the art would recognize on reading the disclosure of the present invention, one drawback of conventional loop antennas is the limited ability to tune the resonance frequency of the loop antenna. The shorting of the radiating element to the ground plane, the placement of the gap or slot on the loop and the attachment of capacitive loading plates to the edges of the loop provide increase ability to tune the resonance frequency(ies) of the loop antenna associated with the present invention.

Referring now to FIG. 1, an embodiment of the present invention is shown. FIG. 1 shows a top or plan view of a loop antenna 100. Loop antenna 100 has a radiating element 102 residing a distance from a ground plane 104. Ground plane 104 is shown having a much larger area than radiating element 102 for illustrative purposes only, and ground plane 104 could have other sizes of larger, smaller, or equal area. Optionally, a dielectric carriage 106 can reside between ground plane 104 and radiating element 102 as a matter of design choice. The shape of loop antenna 100 is shown as a conventional rectangular shape, but the shape is largely dictated by the available space associated with a wireless device (not specifically shown). Thus, loop antenna 100 can have the linear configuration as shown or alternative geometric and/or random configurations.

Loop antenna 100 additionally comprises a slot or gap 108 in radiating element 102, a shorting element 110 shorting radiating element 102 to ground plane 104, and a feed tab 112. Shorting element 110 extends from the edge of radiating element 102 to ground plane 104 while feed tab 112 extends from the edge of radiating element 102 towards ground plane 104, but does not actually connect to ground plane 104. Placement of gap 108, shorting element 110, and feed tab 112 is largely dependent on the resonant frequency (ies) associated with loop antenna 100. Tuning characteristics of loop antenna 100 can be further enhanced by the placement of one or more capacitive loading plates (not specifically shown in FIG. 1) along one or more edges of radiating element 102. The capacitive loading plates, similar to feed tab 112, would extend from the edge of radiating element 102 towards ground plane 104, but would not actually connect to ground plane 104. Antenna 100 has been shown to have improved gain over conventional PIFAs of similar size and decreased volume compared to conventional loop antennas using half wavelength operation.

Figure 2:
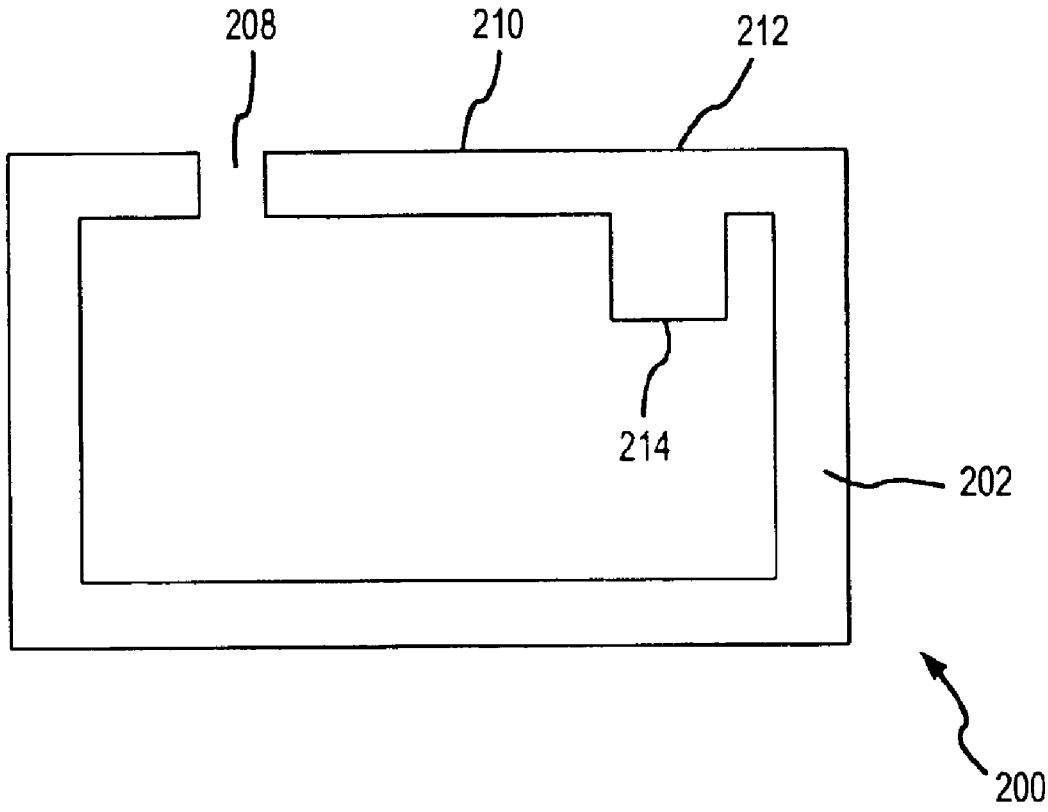
FIG. 2 is a plan view of another embodiment of an antenna consistent with the present invention.

Referring now to FIG. 2, another embodiment of the present invention is shown. For convenience, the ground plane and optional dielectric carriage are not specifically shown. Similar to antenna 100, antenna 200 includes a radiating element 202, a gap 208, a shorting element 210, and a feed tab 212. Further, antenna 200 could have one or more capacitive loading plates arranged along the edge of radiating element 202. Unlike antenna 100, however, antenna 200 includes at least one matching stub 214. Unlike PIFA matching stubs, matching stub 214 can reside internal to the geometry of radiating element 202. Placement and size of gap 208, shorting element 210, feed tab 212, capacitive loading plate(s), and matching stub 214 are largely determined by desired resonant frequency characteristics. Without loss of generality, the matching stub 214 also can be attached to that edge of the radiating element that is opposite to the one containing the shorting element 210.

Figure 3A:
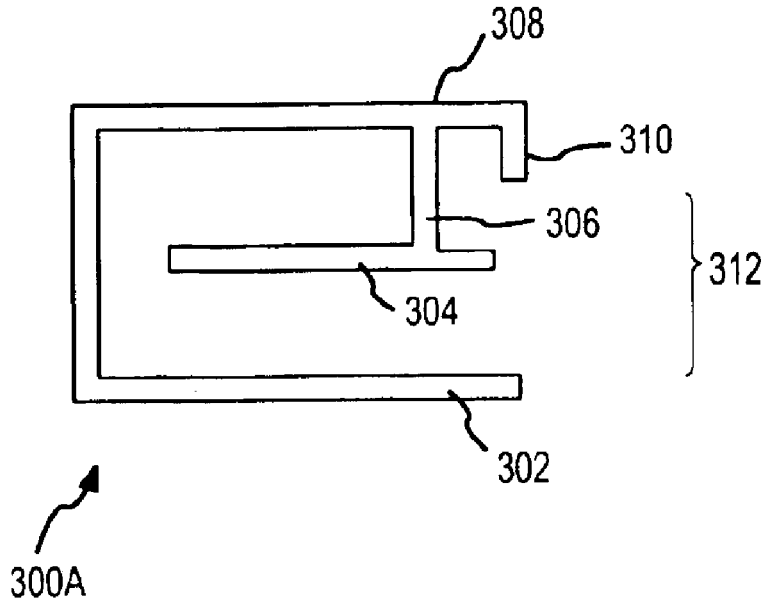
FIG. 3A is a plan view of another embodiment of an antenna consistent with the present invention.
Figure 3B:
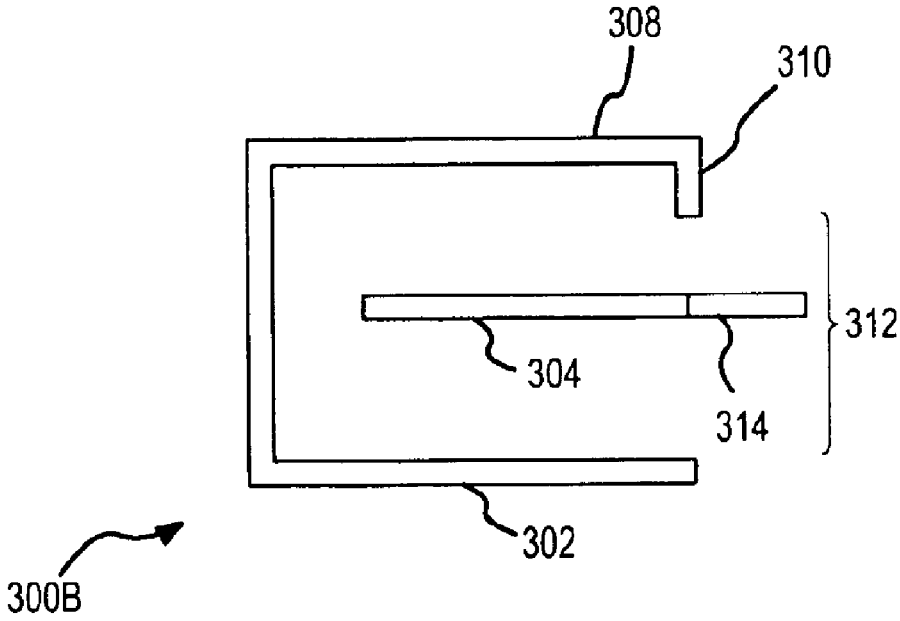
FIG. 3B is a plan view of another embodiment of an antenna consistent with the present invention.

Antennas 100 and 200 are generally associated with single band operation. FIGS. 3A and 3B show exemplary embodiments of loop antennas 300A and 300B capable of multi band operation. FIGS. 3A and 3B are plan views of antenna 300A and 300B, respectfully, and antennas 300A and 300B may be arranged above a ground plane and dielectric carriage, similar to antennas 100 and 200, but not specifically shown in FIGS. 3A and 3B. Referring first to FIG. 3A, antenna 300A includes an outer boundary radiating element 302 and an inner radiating element 304. Inner radiating element 304 is connected to outer boundary radiating element 302 at connection 306. It is believed improved operation of antenna 300A occurs when inner radiating element 304 is located close to a non radiating edge of outer boundary radiating element 302. The edge of the outer boundary radiating element 302 containing the shorting post 310 is referred to as the non radiating edge of the element 302. In this example, a feed tab 308 extends towards a ground plane substantially adjacent connection 306, although other placements are possible. Connection 306 or auxiliary feed provides power from feed tab 308 to inner radiating element 304 making inner radiating element active. A shorting element 310 exists on outer boundary radiating element 302 extending between the outer boundary radiating element 302 and the ground plane (not specifically shown). In this case, shorting element 310 extends into a gap 312 in outer boundary radiating element 302. The position and size of inner radiating element 304 helps regulate upper band resonance frequencies of antenna 300A. Also, while shown with a linear configuration, inner radiating element 304 can have alternative geometries, such as a meanderer geometry, or the like.

FIG. 3B shows a top plan view of antenna 300B. Antenna 300B is similar to antenna 300A in that it contains outer boundary radiating element 302, inner radiating element 304, feed tab 308, and short 310, which as shown is residing in a gap 312. Instead of connection 306, however, antenna 300B has an additional shorted element 314 in gap 312 and the inner radiating element 304 is connected to the shorted element 314. Because inner radiating element 304 is not connected to a power source, it is passive and therefore the inner radiating element 304 serves as a parasitic element to the outer boundary radiating element 302.

For both antenna 300A and 300B, additional inner radiating elements 304 can be used to increase the number of operating bands of the antenna. Also, it is possible to combine active and passive inner radiating elements.

Figure 4:
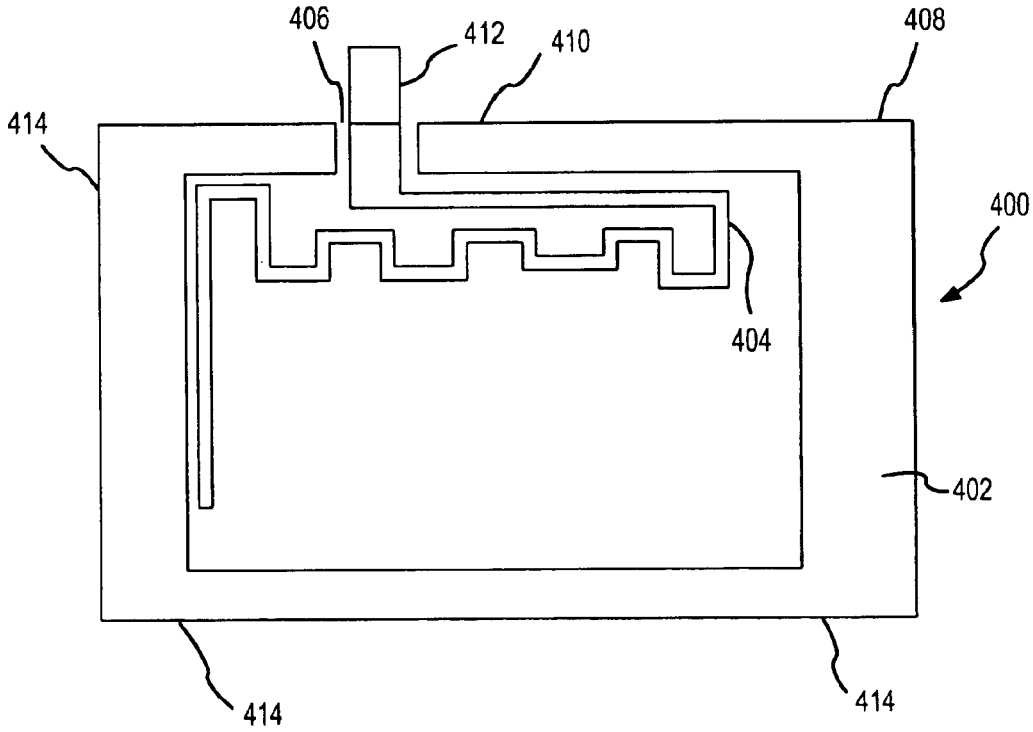
FIG. 4 is a plan view of another embodiment of an antenna consistent with the present invention.
Figure 5:
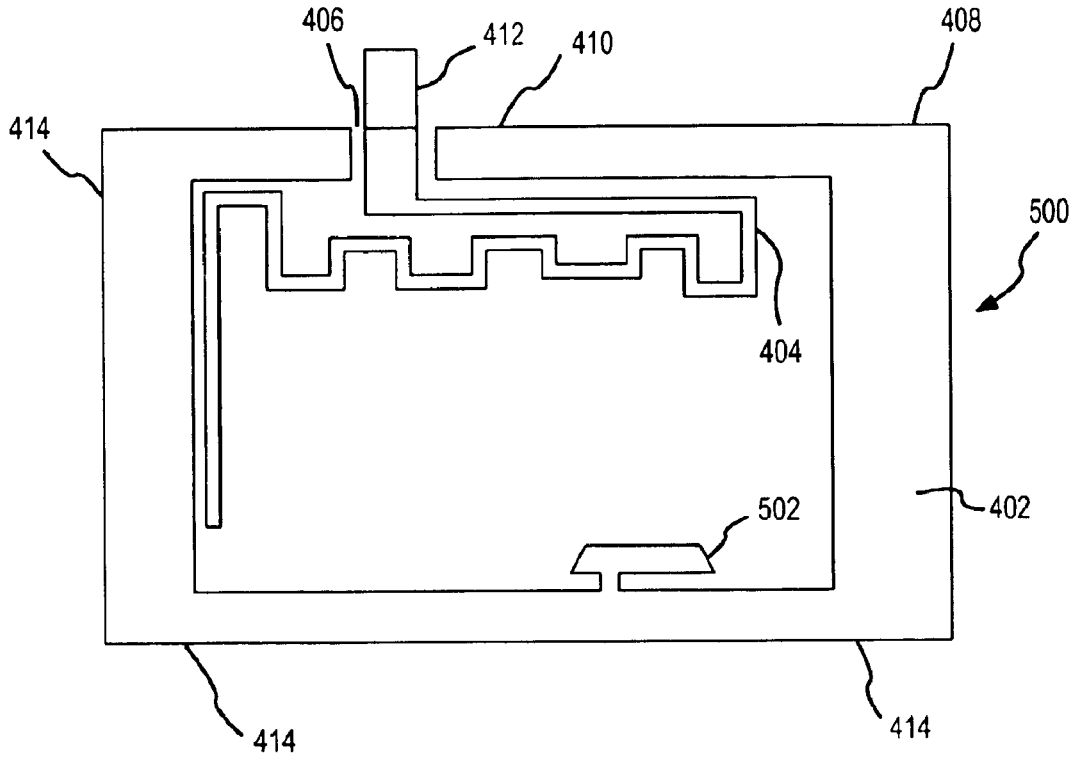
FIG. 5 is a plan view of another embodiment of an antenna consistent with the present invention.

Referring now to FIGS. 4 and 5, plan views of antennas 400 and 500 are shown illustrative of the present invention. Referring first to FIG. 4, antenna 400 includes outer boundary radiating element 402, and inner radiating element 404. As shown, outer boundary radiating element 402 can have various dimensions and does not have to be a consistent thickness around the loop. Inner radiating element 404 can similarly vary in size along its length, and can have alternative geometries, such as the meanderer line shown. Similar to the other antennas disclosed above, antenna 400 includes a gap 406, a feed tab 408, and a shorting element 410. As a passive or parasitic element, inner radiating element 404 has a shorted element 412.

Strategically arranged along the radiating edge of outer boundary radiating element 402 can reside one or more capacitive loading plates 414. The size, shape and number of capacitive loading plates 414 depend on antenna 400's resonant frequency requirements.

Antenna 400 is capable of multi band operation. Multi band operation of antenna 400 is achieved by, among other things, changing the geometry of the gap and/or addition of multiple passive inner loops.

Referring now to FIG. 5, antenna 500 is shown. As can be seen, antenna 500 is mostly identical to antenna 400, but includes a matching stub 502. Use of matching stub 502, as shown, or additional shorting posts and/or strips increases the robustness of the antenna with regard to multi band operation.

While the invention has been particularly shown and described with reference to exemplary embodiments thereof, it will be understood by those skilled in the art that various other changes in the form and details may be made without departing from the spirit and scope of the invention.

We claim:

1. An antenna for a wireless device, comprising:

a ground plane;

a radiating element;

the radiating element comprising a first conductive strip having a first end and second end such that a gap exists between the first end and the second end and the conductive strip forms a loop antenna;

a dielectric space residing between the ground plane and the radiating element;

a shorting element;

the radiating element comprises at least one non radiating edge and at least one radiating edge;

the shorting element residing on a non radiating edge of the radiating element and extending from the radiating element to the ground plane;

a feed tab, and the feed tab residing on the non radiating edge of the radiating element and extending from the radiating element towards the ground plane.

2. The antenna according to claim 1, wherein the loop antenna forms a geometric pattern.

3. The antenna according to claim 2, wherein the geometric pattern is at least one of a rectangular shape, a circular shape, a square shape, an elliptical shape, an oval shape, and a polygonic shape.

4. The antenna according to claim 1, wherein the dielectric space comprises at least one of an air gap and a dielectric carriage.

5. The antenna according to claim 1, further comprising:

at least one capacitive loading plate residing on the radiating edge of the radiating element.

6. The antenna according to claim 1, further comprising:

at least one shorting post residing on the non radiating edge of the radiating element.

7. The antenna according to claim 5, further comprising:

at least one shorting post residing on the non radiating edge of the radiating element.

8. The antenna according to claim 1, further comprising:

at least one matching stub residing on the radiating element.

9. The antenna according to claim 8, wherein the at least one matching stub resides on a radiating edge of the radiating element.

10. The antenna according to claim 1, wherein the radiating element comprises at least one second conductive strip and at least a portion of the at least one second conductive strip is surrounded by the first conductive strip.

11. The antenna according to claim 10, wherein the at least one second conductive strip resides substantially adjacent a non-radiating edge of the first conductive strip.

12. The antenna according to claim 10, wherein the at least one second conductive strip extends into the gap formed by the first conductive strip.

13. The antenna according to claim 10, further comprising a connection between the first conductive strip and the at least one second conductive strip.

14. The antenna according to claim 10, wherein the at least one second conductive strip comprises a geometric shape.

15. The antenna according to claim 10, wherein the at least one second conductive strip comprises a meanderer line.

16. The antenna according to claim 10, further comprising at least one of at least one capacitive loading plate and at least one shorting post.

17. The antenna according to claim 1 operating at a quarter wavelength.

18. The antenna according to claim 10 operating at a quarter wavelength.

19. The antenna according to claim 1 wherein the shorting element is substantially proximate at least one of the first end and the second end.

20. The antenna according to claim 1 wherein the shorting element is located adjacent at least one of the first end and the second end.

21. The antenna according to claim 1 wherein the gap is parallel to a major axis of the ground plane.

22. The antenna according to claim 1 wherein the gap is parallel to a minor axis of the ground plane.

23. The antenna according to claim 21 wherein the gap also is parallel to a minor axis of the ground plane forming an L shape.

24. The antenna according to claim 1 wherein both the shorting element and the feed tab are located proximate the first end.

25. The antenna according to claim 1 wherein both the shorting element and the feed tab are located proximate the second end.

26. The antenna according to claim 8 wherein the at least one matching stub resides on a radiating edge that is opposite to the non radiating edge of the radiating element such that the at least one matching stub is entirely internal to a geometry of the radiating element.

27. A multi band antenna, comprising:

a ground plane;

a first radiating element comprising a first conductive strip, the first conductive strip having a radiating edge opposite a non-radiating edge and a first end and a second end, the first conductive strip is formed into a loop such that the first end and the second end form a gap;

a second radiating element comprising a second conductive strip arranged such that a portion of the second radiating element resides internal to the loop formed by the first conductive strip;

a feed tab;

a shorting element; and a connector joining the first radiating element to the second radiating element.

28. The antenna according to claim 27, wherein the entire second radiating element resides internal to the loop formed by the first radiating element.

29. The antenna according to claim 27, wherein the second radiating element comprises a plurality of internal radiating elements.

30. The antenna according to claim 27, wherein the second radiating element resides substantially adjacent the non-radiating edge of the first conductive strip.

31. The antenna according to claim 27 wherein the ground plane is separated from the first radiating element and the second radiating element by a dielectric space.

32. The antenna according to claim 31, wherein the dielectric space is at least one of air and a dielectric carriage.

33. The antenna according to claim 27, further comprising at least one capacitive loading plate, at least one shorting post, and at least one matching stub.

34. The antenna according to claim 33, wherein the at least one capacitive loading plate resides on the radiating edge of the first conductive strip.

35. The antenna according to claim 33, wherein the at least one shorting post resides on the non radiating edge of the first conductive strip.

36. The antenna according to claim 33, wherein the at least one matching stub resides on the non-radiating edge of the first conductive strip.

37. The antenna according to claim 27, wherein the loop is one of a geometric or irregular shape.

38. The antenna according to claim 37, wherein the geometric shape is at least one of a rectangle, a square, a circle, an oval, an ellipse, and a polygon.

39. The antenna according to claim 27, wherein the first conductive strip comprises a plurality of widths.

40. The antenna according to claim 27, wherein the second conductive strip comprises a geometric shape.

41. The antenna according to claim 27, wherein the second conductive strip comprise a meanderer line.

42. The antenna according to claim 27 wherein the shorting element is substantially proximate at least one of the first end and the second end.

43. The antenna according to claim 27 wherein the shorting element is located adjacent at least one of the first end and the second end.

44. The antenna according to claim 27 wherein the gap is parallel to a major axis of the ground plane.

45. The antenna according to claim 27 wherein the gap is parallel to a minor axis of the ground plane.

46. The antenna according to claim 44 wherein the gap also is parallel to a minor axis of the ground plane forming an L shape.

47. The antenna according to claim 27 wherein both the shorting element and the feed tab are located proximate the first end.

48. The antenna according to claim 27 wherein both the shorting element and the feed tab are located proximate the second end.

49. A multi band antenna, comprising:

a ground plane;

a first radiating element comprising a first conductive strip, the first conductive strip having a radiating edge opposite a non-radiating edge and a first end and a second end, the first conductive strip is formed into a loop such that the first end and the second end form a gap;

a second radiating element comprising a second conductive strip arranged such that a portion of the second radiating element resides internal to the loop formed by the first conductive strip;

a feed tab;

a first shorting element connecting the first radiating element to the ground plane, the first shorting element resides on the non radiating edge of the first radiating element;

a second shorting element connecting the second radiating element to the ground plane, the second radiating element not being directly connected to the first radiating element forming a parasitic element to the first radiating element;

the second shorting element is drawn through the gap formed by the first radiating element;

the first shorting element is generally in the proximity of at least one of the first end or the second end.

50. The antenna according to claim 49, wherein a majority of the second radiating element resides internal to the loop formed by the first radiating element and the shorted parasitic element resides proximate the gap formed by the first radiating element.

51. The antenna according to claim 49, wherein the second radiating element comprises a plurality of inner radiating elements.

52. The antenna according to claim 49, wherein the second radiating element resides substantially adjacent the non-radiating edge of the first conductive strip.

53. The antenna according to claim 49, wherein the ground plane is separated from the first radiating element and the second radiating element by a dielectric space.

54. The antenna according to claim 53, wherein the dielectric space is at least one of air and a dielectric carriage.

55. The antenna according to claim 49, further comprising at least one capacitive loading plate, at least one shorting post, and at least one matching stub.

56. The antenna according to claim 55, wherein the at least one capacitive loading plate resides on the radiating edge of the first conductive strip.

57. The antenna according to claim 55, wherein the at least one shorting post resides on the non radiating edge of the first conductive strip.

58. The antenna according to claim 55, wherein the at least one matching stub resides on the radiating edge of the first conductive strip.

59. The antenna according to claim 49, wherein the loop formed by the first radiating element is one of a geometric or irregular shape.

60. The antenna according to claim 55, wherein the geometric shape is at least one of a rectangle, a square, a circle, an oval, an ellipse, and a polygon.

61. The antenna according to claim 49, wherein the first conductive strip comprises a plurality of widths.

62. The antenna according to claim 49, wherein the second conductive strip comprises a geometric shape.

63. The antenna according to claim 49, wherein the second conductive strip comprises a meanderer line.

64. The antenna according to claim 49 wherein the first shorting element is substantially proximate at least one of the first end and the second end.

65. The antenna according to claim 49 wherein the first shorting element is located adjacent at least one of the first end and the second end.

66. The antenna according to claim 49 wherein the gap is parallel to a major axis of the ground plane.

67. The antenna according to claim 49 wherein the gap is parallel to a minor axis of the ground plane.

68. The antenna according to claim 66 wherein the gap also is parallel to a minor axis of the ground plane forming an L shape.

69. The antenna according to claim 49 wherein both the shorting element and the feed tab are located proximate the first end.

70. The antenna according to claim 49 wherein both the shorting element and the feed tab are located proximate the second end.

71. An internal antenna for a wireless device, comprising:

a ground plane;

means for radiating at least one resonant frequency, wherein the means for radiating comprises at least one loop antenna with a radiating edge and a non radiating edge and having a gap and operating at a quarter wavelength;

means for separating the ground plane from the means for radiating;

means coupled to the non radiating edge for supplying power to the means for radiating;

means coupled to the non radiating edge for shorting the means for radiating to the ground plane; and means for tuning the means for radiating.

* * * * *